US011587712B2

(12) United States Patent
Miyamoto

(10) Patent No.: US 11,587,712 B2
(45) Date of Patent: Feb. 21, 2023

(54) COIL COMPONENT

(71) Applicant: Murata Manufacturing Co., Ltd., Kyoto-fu (JP)

(72) Inventor: Masashi Miyamoto, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 574 days.

(21) Appl. No.: 16/712,759

(22) Filed: Dec. 12, 2019

(65) Prior Publication Data

US 2020/0211750 A1 Jul. 2, 2020

(30) Foreign Application Priority Data

Dec. 29, 2018 (JP) ..... JP2018-248775

(51) Int. Cl.

| | |
|---|---|
| ***H01F 17/04*** | (2006.01) |
| ***H01F 27/29*** | (2006.01) |
| ***H01F 27/30*** | (2006.01) |
| ***H01F 27/28*** | (2006.01) |

(52) U.S. Cl.

CPC ..... *H01F 17/045* (2013.01); *H01F 27/2828* (2013.01); *H01F 27/292* (2013.01); *H01F 27/306* (2013.01)

(58) Field of Classification Search

CPC .. H01F 17/045; H01F 27/2828; H01F 27/292; H01F 27/306; H01F 27/29; H01F 5/00; H01F 5/04

See application file for complete search history.

(56) References Cited

U.S. PATENT DOCUMENTS

| | | | | |
|---|---|---|---|---|
| 2015/0028985 | A1* | 1/2015 | Inubushi | H01F 17/04 264/319 |
| 2018/0308621 | A1* | 10/2018 | Tanaka | H01F 17/045 |
| 2020/0203052 | A1* | 6/2020 | Murakami | H01F 27/2828 |
| 2020/0251276 | A1* | 8/2020 | Nishimura | H01F 27/24 |

FOREIGN PATENT DOCUMENTS

| | | | |
|---|---|---|---|
| CN | 1949415 | A | 4/2007 |
| JP | 2006-286807 | A | 10/2006 |
| JP | 2011-216681 | A | 10/2011 |
| JP | 2014-216347 | A | 11/2014 |
| JP | 2017-092349 | A | 5/2017 |
| JP | 2017-098382 | A | 6/2017 |

OTHER PUBLICATIONS

An Office Action mailed by China National Intellectual Property Administration dated May 17, 2021 which corresponds to Chinese Application No. 201911308152.7 and is related to U.S. Appl. No. 16/712,759 with English language translation.

An Office Action; "Notice of Reasons for Refusal," mailed by the Japanese Patent Office dated Jun. 8, 2021, which corresponds to Japanese Patent Application No. 2018-248775 and is related to U.S. Appl. No. 16/712,759 with English language translation.

* cited by examiner

*Primary Examiner* — Alvaro E Fortich
*Assistant Examiner* — Zannatul Ferdous
(74) *Attorney, Agent, or Firm* — Studebaker & Brackett PC

(57) ABSTRACT

Terminal electrodes are disposed on mounting surfaces of flanges of a substantially drum-shaped core that are directed to a mounting substrate. A rounded surface is formed on the mounting surface. An end portion of the wire extends along the rounded surface from a side on which the inner end surface is present toward a side on which the outer end surface is present.

20 Claims, 6 Drawing Sheets

COIL COMPONENT

CROSS-REFERENCE TO RELATED APPLICATION

This application claims benefit of priority to Japanese Patent Application No. 2018-248775, filed Dec. 29, 2018, the entire content of which is incorporated herein by reference.

BACKGROUND

Technical Field

The present disclosure relates to a wire-wound coil component having a structure in which a wire is wound around a substantially drum-shaped core, and more particularly to a structure of a connection portion in which the wire and a terminal electrode are connected to each other.

Background Art

For example, Japanese Unexamined Patent Application Publication No. 2006-286807 or Japanese Unexamined Patent Application Publication No. 2011-216681 describes a wire-wound coil component in which end portions of a wire are connected, by thermocompression bonding, to terminal electrodes that are provided on flange portions of a substantially drum-shaped core, the flange portions being positioned at the opposite ends of the substantially drum-shaped core.

FIG. 8 is an enlarged cross-sectional view of a portion of a flange portion 2 that is positioned at one end of a substantially drum-shaped core 1. The flange portion 2 illustrated in FIG. 8 has a mounting surface 3 that is directed to a mounting substrate at the time of mounting a coil component, and a terminal electrode 4 is provided on the mounting surface 3. For example, the terminal electrode 4 includes a conductor film that serves as a base and that is formed by baking an electrically conductive paste containing silver as an electrically conductive component and a plating film that is made of Ni, Cu, Sn, or the like and that is formed on the conductor film. Note that the surface of the terminal electrode 4 is formed of a tin-plated film in order to achieve favorable solderability at the time of mounting the coil component.

In contrast, an end portion of a wire 6 that is wound around a winding core portion 5 of the substantially drum-shaped core 1 in a substantially helical manner is connected to the above-mentioned terminal electrode 4 by thermocompression bonding. For example, the wire 6 is formed of a copper wire and is coated with an insulating film made of a resin such as polyurethane or a polyimide. The insulating film made of the resin is decomposed by, for example, heat, which is applied when thermocompression bonding is performed, and removed.

SUMMARY

In order to sufficiently and properly achieve the thermocompression bonding of the wire 6 to the terminal electrode 4 as illustrated in FIG. 8, it is necessary to apply heat at a relatively high temperature, which is, for example, about 300° C. to about 500° C., and a relatively high pressure to the wire 6 so as to cause moderate plastic deformation of the wire 6.

However, the inventor of the present disclosure has discovered that, as a result of applying pressure in the above-mentioned thermocompression bonding process, a stress is concentrated at a portion 8 of the wire 6 that is located in the vicinity of a ridge line where the mounting surface 3 of the flange portion 2 and an inner end surface 7 of the flange portion 2 intersect each other, so that the wire 6 may sometimes be easily broken at the portion 8. More specifically, it was found that the above-mentioned breakage of the wire 6 occurs when, for example, the diameter of the wire 6 is reduced to about 15 μm to about 100 μm with the reduction in the size of the coil component or when the coil component is exposed to at a high temperature of about 120° C. to about 150° C.

Accordingly, the present disclosure provides a coil component having a structure capable of simultaneously achieving prevention of wire breakage and stable thermocompression bonding.

First and second embodiments of the present disclosure are each directed to a coil component that includes a substantially drum-shaped core including a winding core portion and a flange portion that is provided at an end portion of the winding core portion, a wire wound around the winding core portion, and a terminal electrode to which an end portion of the wire is connected.

The flange portion has an inner end surface that faces the winding core portion and that positions the end portion of the winding core portion, an outer end surface that is opposite to the inner end surface and that faces outward, and a mounting surface that connects the inner end surface and the outer end surface to each other and that is directed to a mounting substrate at the time of mounting the coil component. In addition, the terminal electrode is disposed on the mounting surface of the flange portion.

In the coil component according to the first embodiment, a rounded surface is formed on the mounting surface, the rounded surface having a central axis that linearly extends in a widthwise direction parallel to the mounting surface and the outer end surface and having a curvature radius that is longer than a distance between the inner end surface and the outer end surface, and the end portion of the wire extends along the rounded surface from a side on which the inner end surface is present toward a side on which the outer end surface is present.

According to the second embodiment, a recess and a flat surface, which is different from the recess, are formed in and on the mounting surface, the recess being open on a side on which the inner end surface is present. The end portion of the wire is received in the recess from the side on which the inner end surface is present toward a side on which the outer end surface is present and has a thickness that continuously changes such that the thickness is relatively thin on the side on which the outer end surface is present and is relatively thick on the side on which the inner end surface is present.

The coil component according to preferred embodiments of the present disclosure can simultaneously achieve prevention of wire breakage and stable thermocompression bonding.

Other features, elements, characteristics and advantages of the present disclosure will become more apparent from the following detailed description of embodiments with reference to the attached drawings.

DETAILED DESCRIPTION

Figure 1:
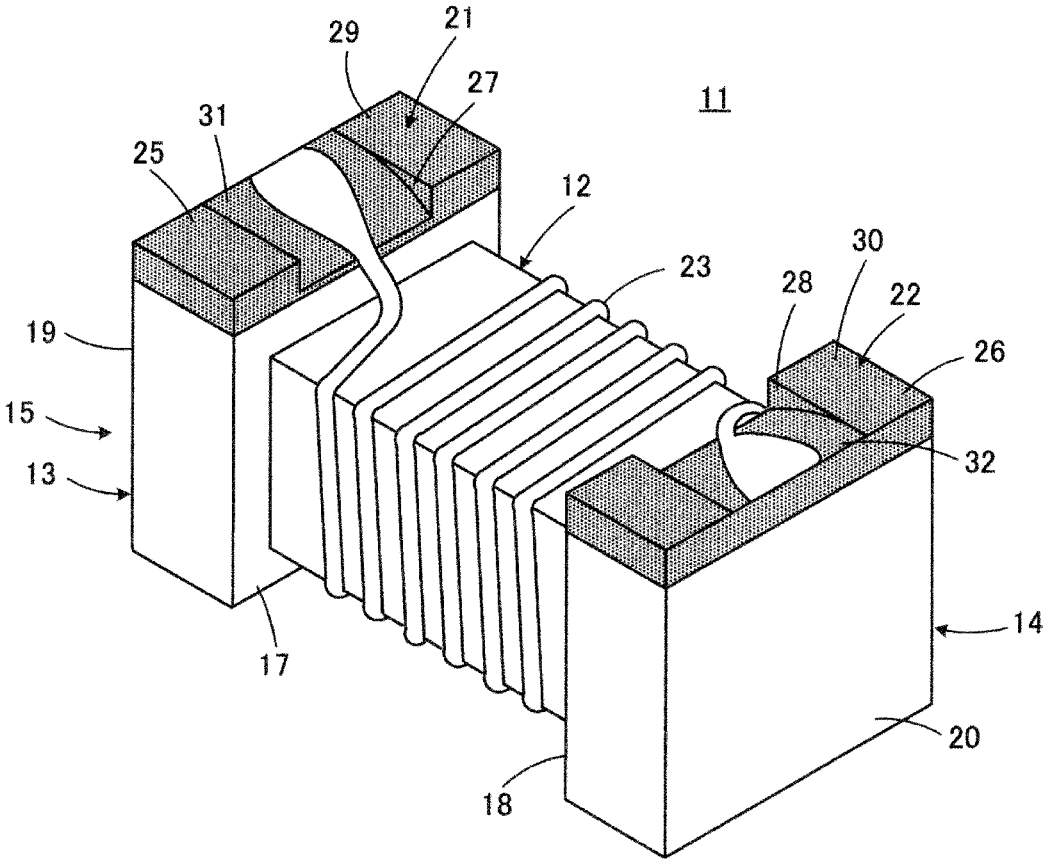
FIG. 1 is a perspective view illustrating the appearance of a coil component according to a first embodiment of the present disclosure while a surface of the coil component that is to be directed to a mounting substrate faces upward.

FIG. 1 illustrates the appearance of a coil component 11 according to a first embodiment of the present disclosure. In FIG. 1, a surface of the coil component 11 that is to be directed to a mounting substrate faces upward.

Referring to FIG. 1, the coil component 11 includes a substantially drum-shaped core 15 that includes a winding core portion 12, a first flange portion 13, and a second flange portion 14. The first flange portion 13 and the second flange portion 14 are respectively provided on a first end portion and a second end portion of the winding core portion 12 that oppose each other. The substantially drum-shaped core 15 is made of, for example, alumina, ferrite, or the like. In addition, the substantially drum-shaped core 15 has a dimension of, for example, about 0.4 mm to about 4.5 mm in the longitudinal direction thereof. The substantially drum-shaped core 15 is solely illustrated in FIG. 2.

Figure 2:
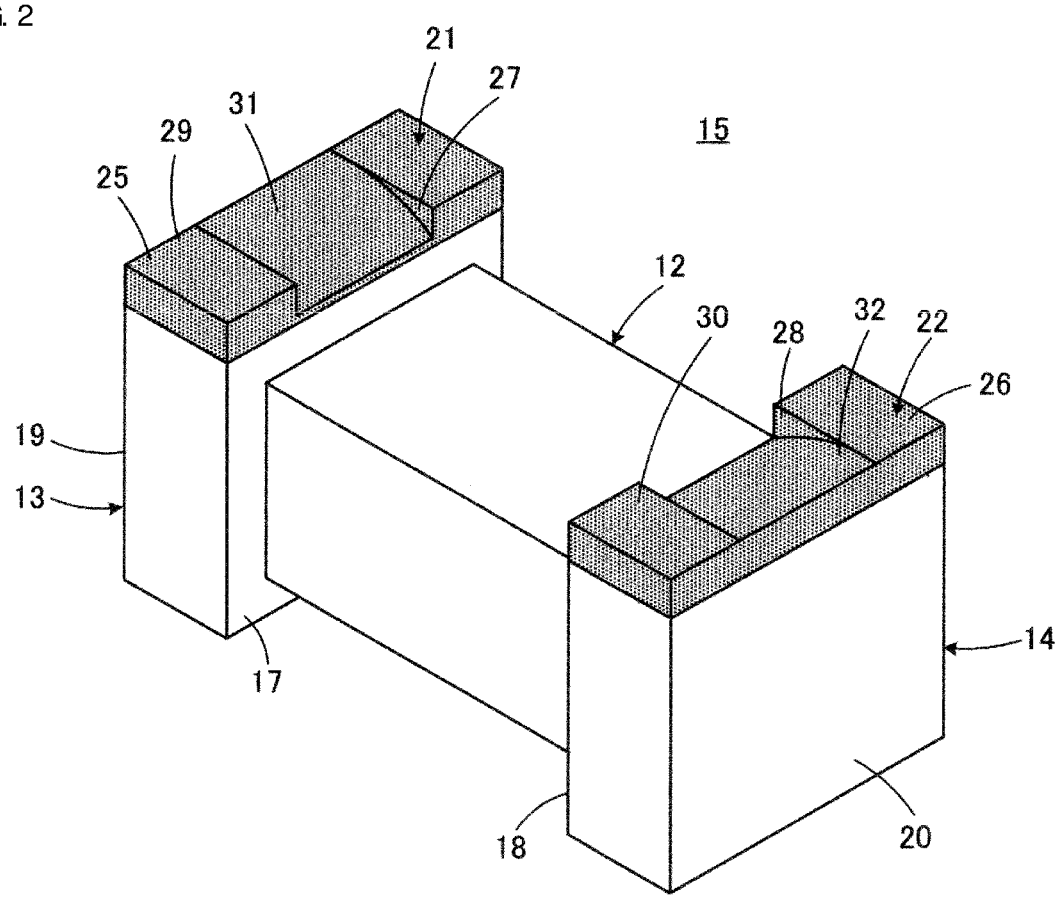
FIG. 2 is a perspective view illustrating the appearance of a substantially drum-shaped core that is included in the coil component illustrated in FIG. 1 while surfaces of the substantially drum-shaped core that are to be directed to the mounting substrate face upward.

Referring to FIG. 1 and FIG. 2, the first flange portion 13 has an inner end surface 17, an outer end surface 19, and a mounting surface 21, and the second flange portion 14 has an inner end surface 18, an outer end surface 20, and a mounting surface 22. The inner end surface 17 faces the winding core portion 12 and positions the first end portion of the winding core portion 12, and the inner end surface 18 faces the winding core portion 12 and positions the second end portion of the winding core portion 12. The outer end surface 19 is opposite to the inner end surface 17 and faces outward, and the outer end surface 20 is opposite to the inner end surface 18 and faces outward. The mounting surface 21 connects the inner end surface 17 and the outer end surface 19 to each other and is directed to the mounting substrate at the time of mounting the coil component 11, and the mounting surface 22 connects the inner end surface 18 and the outer end surface 20 to each other and is directed to the mounting substrate at the time of mounting the coil component 11.

The coil component 11 further includes a wire 23 that is wound around the winding core portion 12 of the substantially drum-shaped core 15, a first terminal electrode 25, and a second terminal electrode 26. A first end portion and a second end portion of the wire 23 are respectively connected to the first terminal electrode 25 and the second terminal electrode 26. The regions in which the terminal electrodes 25 and 26 are formed are illustrated by half-tone shading in FIG. 1 and FIG. 2. The first terminal electrode 25 is formed so as to cover the entire mounting surface 21 of the first flange portion 13, and the second terminal electrode 26 is formed so as to cover the entire mounting surface 22 of the second flange portion 14.

For example, the terminal electrodes 25 and 26 are formed as follows. An electrically conductive paste in which a resin binder contains silver as an electrically conductive component and glass frit as an adhesive component is applied to the mounting surfaces 21 and 22 by a dip method and then baked, so that a conductor film that serves as a base is formed. Subsequently, the conductor film serving as a base is plated with Ni, Cu, Sn, or the like. As a result of performing the above-mentioned dip method, the terminal electrodes 25 and 26 are formed in such a manner as to extend from their respective mounting surfaces 21 and 22 to portions of surfaces adjacent to the mounting surfaces 21 and 22. Note that it is preferable that a surface of each of the terminal electrodes 25 and 26 be formed of a tin-plated film in order to achieve favorable solderability at the time of mounting the coil component 11. In addition, the plating film may be formed only around the portions of the terminal electrodes 25 and 26 to each of which the wire 23 is connected.

The above-mentioned wire 23 is formed of, for example, a core wire that is made of Cu and that has a diameter of about 15 μm to about 200 μm and has a structure in which the core wire is coated with an insulating film that is made of a resin such as polyurethane or a polyimide and that has a thickness of about a few μm. Thermocompression bonding is employed for connecting the end portions of the wire 23 to the terminal electrodes 25 and 26. For example, the insulating film coating each of the end portions of the wire 23 is removed as a result of being decomposed by heat that is applied thereto when the thermocompression bonding is performed or by being irradiated with laser.

The mounting surface 21 of the first flange portion 13 and the mounting surface 22 of the second flange portion 14 are each provided with a characteristic shape such as that described later. Note that such a characteristic shape is not provided only by, for example, performing barrel polishing or the like and is ultimately obtained as a result of being provided during a process of forming the substantially drum-shaped core 15, and such a characteristic shape is a configuration that clearly remains after post-processes, such as firing and barrel polishing, have been performed on the substantially drum-shaped core 15.

The circumstances under which the inventor of the present disclosure has adopted characteristic configurations according to embodiments of the present disclosure will be described below.

Figure 8:
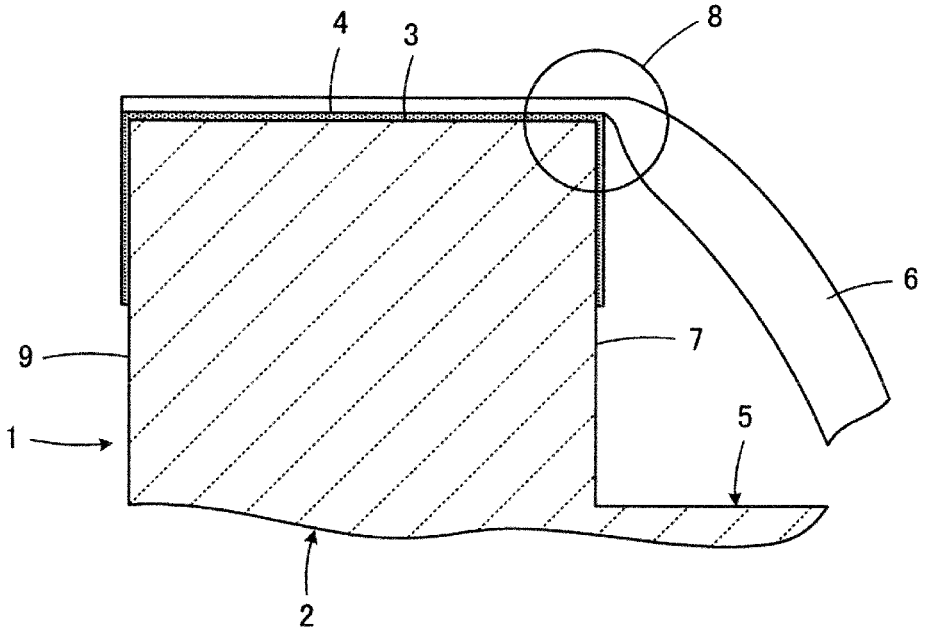
FIG. 8 is an enlarged cross-sectional view of a portion of a substantially drum-shaped core and a portion of a wire that are included in a coil component of the related art.

Referring to FIG. 8, which has been described above, the inventor of the present disclosure presumes that copper that forms a central conductor of the wire 6, which has undergone thermocompression bonding, generates an alloy between tin forming the surface of the terminal electrode 4 and tin contained in solder used at the time of mounting the coil component and becomes brittle under a severe temperature condition, and as a result, the wire 6 is easily broken at the portion 8, which is located in the vicinity of the ridge line and where a stress is particularly likely to be concentrated.

Note that the inventor of the present disclosure also found that breaking of the wire 6 as a result of such a series of events is more likely to occur as the wire 6 becomes thicker.

Although the substantially drum-shaped core 1 is made of, for example, alumina, ferrite, or the like, barrel polishing is performed on the substantially drum-shaped core 1 after the substantially drum-shaped core 1 has been formed and fired. In this barrel polishing, a ridge line portion between the mounting surface 3 and the inner end surface 7 of the flange portion 2 and a ridge line portion between the mounting surface 3 and an outer end surface 9 are round-chamfered. Note that the state in which the ridge line portions are round-chamfered is not illustrated in FIG. 8. It is easily conceivable that the degree of progress of the round chamfering is lower in the ridge line portion between the mounting surface 3 and the inner end surface 7 than in the ridge line portion between the mounting surface 3 and an outer end surface 9. This is because the collision probability with a granular abrasive material is lower at the ridge line portion between the mounting surface 3 and the inner end surface 7 than at the ridge line portion between the mounting surface 3 and an outer end surface 9. Thus, the ridge line portion between the mounting surface 3 and the inner end surface 7 remains sharper than the ridge line portion between the mounting surface 3 and an outer end surface 9, and the radius of curvature of the ridge line portion between the mounting surface 3 and the inner end surface 7 decreases to be smaller than that of the ridge line portion between the mounting surface 3 and an outer end surface 9. This is also presumed to be one of the factors that cause the wire 6 to easily break at the portion 8, which is located in the vicinity of the ridge line.

In order to reduce the probability of occurrence of the above-mentioned breakage of the wire 6, it may be considered to reduce the pressure that is applied to the wire 6 at the time of thermocompression bonding so as to reduce the degree of plastic deformation that occurs in the wire 6. However, from the standpoint of the adhesion strength between the wire 6 and the terminal electrode 4, it is essential to apply a sufficient pressure when the thermocompression bonding is performed while maintaining the temperature sufficiently high, and in order to sufficiently and properly achieve the thermocompression bonding, the pressure cannot be simply reduced. In any case, it is important to adjust the pressure applied at the time of performing the thermocompression bonding. On the other hand, adjustment of the pressure is extremely subtle, and it is undeniable that stable setting of an appropriate pressure is difficult to achieve.

Under the above-mentioned circumstances, it was found that it is preferable that the embodiments of the present disclosure have the following features.

The mounting surface 21 has a recess 27 that is open on the side on which the inner end surface 17 is present and a flat surface 29 that is formed in a region other than the recess 27, and the mounting surface 22 has a recess 28 that is open on the side on which the inner end surface 18 is present and a flat surface 30 that is formed in a region other than the recess 28. The recess 27 extends from the side on which the inner end surface 17 is present toward the side on which the outer end surface 19 is present, and the recess 28 extends from the side on which the inner end surface 18 is present toward the side on which the outer end surface 20 is present. As illustrated in detail in FIG. 3, which illustrates the recess 27, at least a portion of the bottom surface of the recess 27 forms a rounded surface 31, and at least a portion of the bottom surface of the recess 28 forms a rounded surface 32. In the present embodiment illustrated in FIG. 3, the entire bottom surfaces of the recesses 27 and 28 are respectively formed of the rounded surfaces 31 and 32.

Note that the terminal electrodes 25 and 26 are respectively formed over the entire mounting surfaces 21 and 22. Consequently, the recesses 27 and 28, the flat surfaces 29 and 30, and the rounded surfaces 31 and 32, which have been described above, are shapes provided by the mounting surfaces 21 and 22. However, the recesses 27 and 28, the flat surfaces 29 and 30, and the rounded surfaces 31 and 32, will hereinafter sometimes be described as shapes provided by the terminal electrodes 25 and 26.

Figure 3:
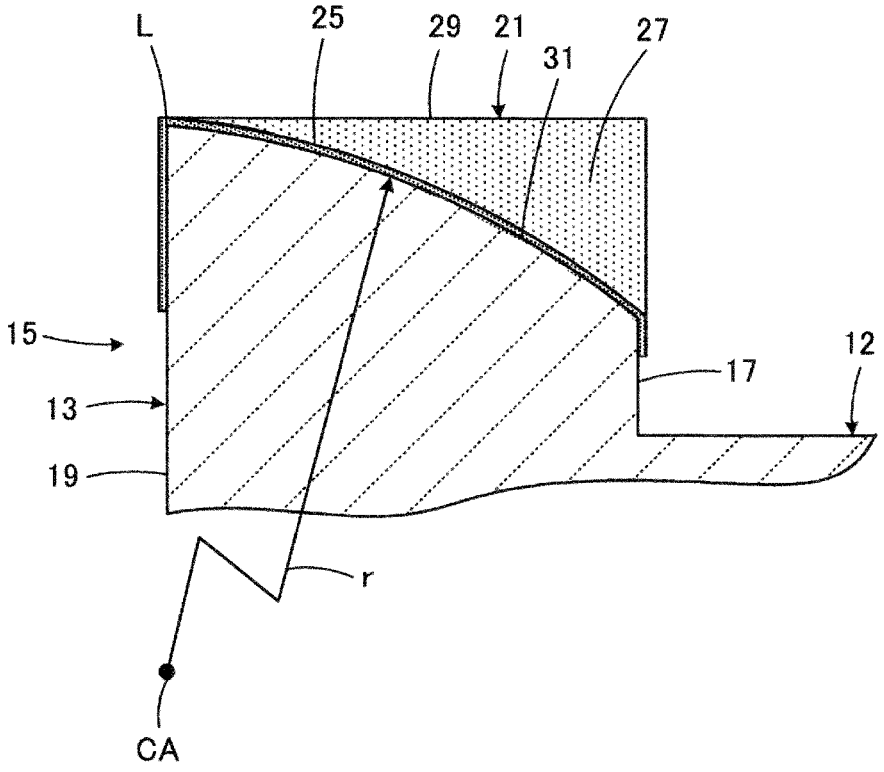
FIG. 3 is an enlarged cross-sectional view of a portion of the substantially drum-shaped core illustrated in FIG. 2.
Figure 4:
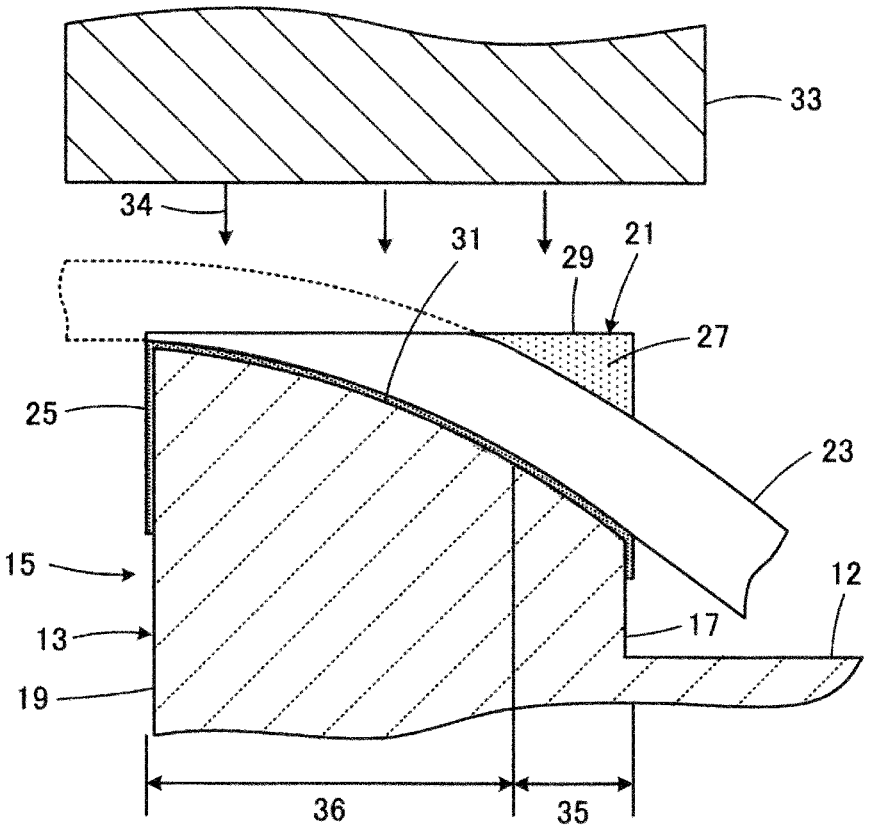
FIG. 4 is for describing a thermocompression bonding process and is an enlarged cross-sectional view illustrating a portion of the substantially drum-shaped core and a portion of a wire that are included in the coil component illustrated in FIG. 1.

A configuration on the side on which the first flange portion 13 illustrated in FIG. 3 and FIG. 4 is present will be described below. A configuration on the side on which the second flange portion 14 is present is symmetrical to the configuration on the side on which the first flange portion 13 is present, and thus, the description thereof will be omitted.

As illustrated in FIG. 3, the rounded surface 31 forming the bottom surface of the recess 27, which is formed in the mounting surface 21 of the first flange portion 13, has a central axis CA linearly extending in a widthwise direction parallel to the mounting surface 21 and the outer end surface 19 and has a curvature radius r that is longer than the distance between the inner end surface 17 and the outer end surface 19, that is, the thickness of the first flange portion 13. Note that the curvature radius r may be infinite. Although the central axis CA is not necessarily parallel to a ridge line L, it is preferable that the central axis CA extend parallel to or approximately parallel to the ridge line L. In addition, as may be inferred from FIG. 3, it is preferable that the central axis CA be located on a plane in which the outer end surface 19 extends or be located outside the plane in which the outer end surface 19 extends. With such a configuration, the highest point of the rounded surface 31 that is illustrated in FIG. 3 can be located at the position of the ridge line L. This is advantageous for performing a thermocompression bonding process, which will be described later with reference to FIG. 4.

In addition, as a result of forming the rounded surface 31 as described above, the bottom surface of the recess 27 forms a slope that is relatively shallow on the side on which the outer end surface 19 is present and that is relatively deep on the side on which the inner end surface 17 is present when seen as a whole. In other words, the recess 27 becomes deeper from the side on which the outer end surface 19 is present to the side on which the inner end surface 17 is present. In addition, the bottom surface of the recess 27 has a portion that is positioned such that the difference between the heights of the portion and the flat surface 29 is equal to or smaller than the diameter of the wire 23. This is also advantageous for performing the thermocompression bonding process, which will be described later with reference to FIG. 4. In the embodiment illustrated in FIG. 3, the bottom surface of the recess 27 excluding a limited portion thereof that is located in the vicinity of the inner end surface 17 is positioned such that the difference between the heights of the bottom surface of the recess 27 and the flat surface 29 is equal to or smaller than the diameter of the wire 23. Here, to be exact, the diameter of the wire 23 is the diameter of a portion of the wire 23 that is wound around the winding core portion 12 (a portion of the wire 23 that is not pressed and deformed in the radial direction thereof).

Note that the axial direction of the wire 23 is not necessarily parallel to the flat surface 29, and thus, it should be understood that the difference between the heights of the bottom surface of the recess 27 and the flat surface 29 refers to the difference between the heights that is measured in the radial direction of the wire 23, and more precisely, the diameter of the portion of the wire 23 that is wound around the winding core portion 12.

In addition, the flat surface 29 is positioned such that the recess 27 is sandwiched by portions of the flat surface 29 as illustrated in FIG. 1 and FIG. 2. This is also advantageous for performing the thermocompression bonding process, which will be described later with reference to FIG. 4.

As illustrated in FIG. 4, when the thermocompression bonding process is performed, the end portion of the wire 23 that is connected to the terminal electrode 25 is received in the recess 27 and positioned along the rounded surface 31 while extending from the side on which the inner end surface 17 is present toward the side on which the outer end surface 19 is present. In FIG. 4, a portion of the wire 23 that has not yet undergone the thermocompression bonding is indicated by a dashed line.

Next, the thermocompression bonding process is started, and in the thermocompression bonding process, a thermocompression-bonding head 33 moves downward in the direction of arrows 34 toward the mounting surface 21 of the flange portion 13 and applies pressure to the end portion of the wire 23 while heating the end portion of the wire 23 so as to cause the wire 23 to become plastically deformed as indicated by a solid line. Here, although the thermocompression bonding temperature varies depending on the material of the insulating film of the wire 23, the thermocompression bonding temperature is selected from, for example, the range of about 300° C. to about 500° C. In addition, the thermocompression bonding pressure is selected from, for example, the range of about several tens kgf to about several kgf when the diameter of the wire 23 is about 15 μm to about 200 μm.

The insulating film coating the end portion of the wire 23 is removed, at a relatively early stage of the above-described thermocompression bonding process, as a result of being decomposed by heat that is applied thereto by the thermocompression-bonding head 33.

Subsequently, the thermocompression-bonding head 33 further moves downward in the direction of arrows 34, and the end portion of the wire 23 is pressed between the thermocompression-bonding head 33 and the rounded surface 31 so as to deform in the radial direction. As a result, as indicated by a solid line in FIG. 4, the end portion of the wire 23 is plastically deformed and heated so as to be bonded to the terminal electrode 25. At the same time, the wire 23 is cut off at an edge of a ridge line where the outer end surface 19 of the flange portion 13 and the rounded surface 31 intersect each other. The thermocompression bonding process is completed in the manner described above. FIG. 1 illustrates the state in which the thermocompression bonding process has been completed and in which the end portions of the wire 23 have been bonded to the terminal electrodes 25 and 26.

As illustrated in FIG. 4, in a state where the wire 23 has become plastically deformed after being subjected to the above-described thermocompression bonding process, one of the end portions of the wire 23 has a thickness that continuously changes such that the thickness is relatively thin on the side on which the outer end surface 19 is present and is relatively thick on the side on which the inner end surface 17 is present. Particularly, in the present embodiment, the entire bottom surface of the recess 27 is not positioned such that the difference between the heights of the entire bottom surface of the recess 27 and the flat surface 29 is equal to or smaller than the diameter of the wire 23, and the difference between the heights of the limited portion of the bottom surface of the recess 27, which is located in the vicinity of the inner end surface 17, and the flat surface 29 is larger than the diameter of the wire 23. Therefore, in the above-mentioned limited portion that is located in the vicinity of the inner end surface 17, there is a region 35 where no plastic deformation occurs in the wire 23.

There is a region 36 that is next to, on the side on which the outer end surface 19 is present, the above-mentioned region 35 and in which the thickness of the end portion of the wire 23 continuously changes so as to be gradually decrease. Such continuous changes in the thickness are caused by the rounded surface 31. In the region 36 where the thickness of the end portion of the wire 23 continuously changes, a region is obtained in which the pressure that is applied to the wire 23 by the thermocompression-bonding head 33 continuously changes in the lengthwise direction of the wire 23 such that the pressure gradually increases from a position where the wire is relatively weakly pressed by the thermocompression-bonding head 33 to a position where the wire 23 is relatively strongly pressed by the thermocompression-bonding head 33. By increasing the above-mentioned curvature radius r of the rounded surface 31 such that the curvature radius r becomes longer than the distance between the inner end surface 17 and the outer end surface 19, more gradual changes in the pressure can be achieved over a wider area in the region 36.

More specifically, as illustrated in FIG. 4, in the state where the thermocompression bonding process has been performed, significant plastic deformation of the wire 23 is caused on the side on which the outer end surface 19 of the flange portion 13 is present so that the wire 23 is bonded to the terminal electrode 25. In this case, a relatively strong pressure is applied to the wire 23, and thus, the wire 23 has a relatively large peel strength with respect to the terminal electrode 25. In contrast, the pressure applied to the wire 23 is relatively low on the side on which the inner end surface 17 of the flange portion 13 is present, and thus, the wire 23 has only a relatively small peel strength with respect to the terminal electrode 25. Instead, the strength of the wire 23 itself is maintained with almost no decrease because the amount of deformation of the wire 23 is relatively small.

Here, assume that a force that tries to peel off the wire 23 is applied to the wire 23 from the outside. In this case, there are two conceivable types of breakage. One is that the wire 23 becomes separated from the terminal electrode 25 due to insufficient press bonding, and the other is that the wire 23 breaks because the wire 23 has become too thin as a result of undergoing the thermocompression bonding.

In the region 36 where the thickness of the end portion of the wire 23 continuously changes as illustrated in FIG. 4, an area that is located on the side on which the outer end surface 19 is present and where the press-bonding strength is relatively large while the thickness of the wire 23 is small and an area where the press-bonding strength is relatively small while the strength of the wire 23 is relatively large because the amount of deformation of the wire 23 is small are smoothly continuous with each other along the rounded surface 31. Thus, when a peeling force is applied to the wire 23 from the outside, an area where the wire 23 is less likely to be peeled off against the peeling force and is less likely to break, that is, an area where an appropriate pressure is applied to the wire 23 inevitably appears somewhere midway in the region 36. Therefore, accidental breakage of the wire 23 is prevented from occurring, and sufficient and proper thermocompression bonding can be stably achieved.

When the above-described thermocompression bonding is performed, the flat surface 29, which is formed on the portion of the mounting surface 21 of the flange portion 13 excluding the recess 27, serves to prevent application of excessive pressure by the thermocompression-bonding head 33. In other words, termination of the downward movement of the thermocompression-bonding head 33 in the direction of arrows 34 is provided by the flat surface 29. As in the present embodiment, by positioning the flat surface 29 such that the recess 27 is sandwiched by the portions of the flat surface 29, the termination of the downward movement of the thermocompression-bonding head 33 can be stably provided. Note that, regarding the widthwise dimension of the substantially drum-shaped core 15, it is preferable that the recess 27 be about 1.0 times or more of the wire 23 and be about ⅔ or less of the flange portion 13.

Figure 5:
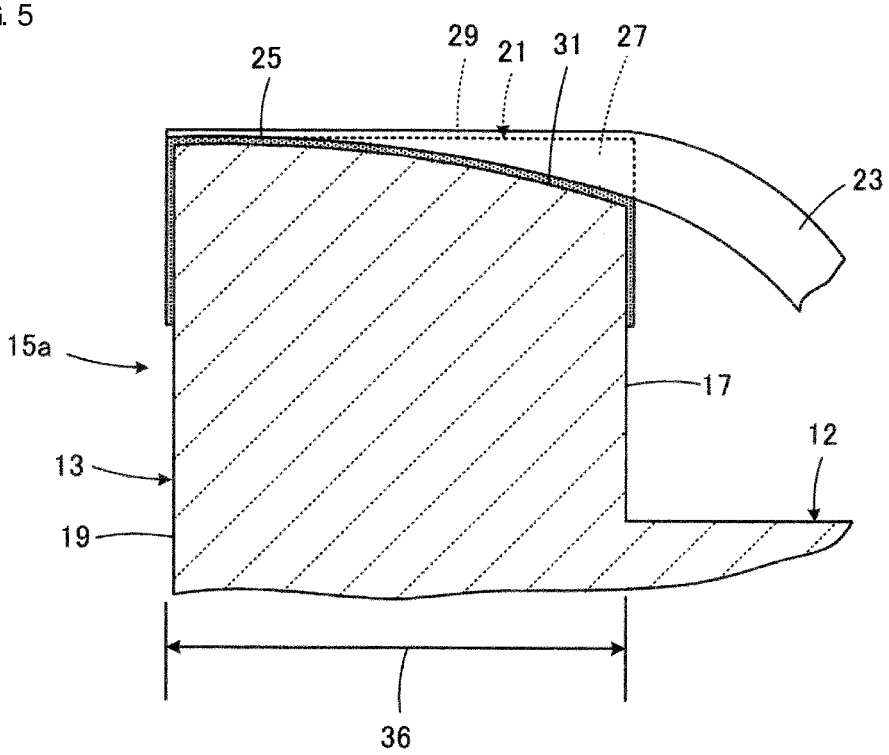
FIG. 5 is an enlarged view of a portion of a substantially drum-shaped core and a portion of the wire that are included in a coil component according to a second embodiment of the present disclosure and corresponds to FIG. 4.

A second embodiment of the present disclosure will now be described with reference to FIG. 5. FIG. 5 corresponds to FIG. 4 and illustrates a portion of a substantially drum-shaped core 15*a* and a portion of the wire 23 that are included in a coil component. In FIG. 5, components that correspond to those illustrated in FIG. 4 are denoted by the same reference signs, and repeated descriptions thereof will be omitted.

In the second embodiment illustrated in FIG. 5, the entire bottom surface of the recess 27 is positioned such that the difference between the heights of the entire bottom surface of the recess 27 and the flat surface 29 is equal to or smaller than the diameter of the portion of the wire 23 that is wound around the winding core portion 12. In this case, it is preferable that the difference between the heights of an end portion of the bottom surface of the recess 27 that is located on the side on which the inner end surface 17 is present and the flat surface 29 be about 0.5 to about 1.0 times the diameter of the wire 23.

According to the present embodiment, there is substantially no region 35 (see FIG. 4), in which plastic deformation does not occur in the wire 23, and a region 36 where the thickness of the end portion of the wire 23 continuously changes so as to be gradually decrease is present throughout the recess 27.

In the second embodiment, as described above, since there is substantially no region 35, in which plastic deformation does not occur in the wire 23, there is a possibility that the variation width of the thickness of the wire 23 in the region 36, where the thickness of the end portion of the wire 23 continuously changes so as to be gradually decrease, may be narrower than that in the above-described first embodiment. Thus, in order to always form an area where the wire 23 is less likely to be peeled off against a peeling force applied from the outside and is less likely to break, that is, an area where an appropriate pressure is applied to the wire 23 in the region 36, it is necessary to increase the difference in the heights the end portion of the bottom surface of the recess 27 that is located on the side on which the inner end surface 17 is present and the flat surface 29 to a certain extent or more, and thus, it is preferable that the difference in the heights be about 0.5 times or more the diameter of the wire 23 as mentioned above.

Figure 6:
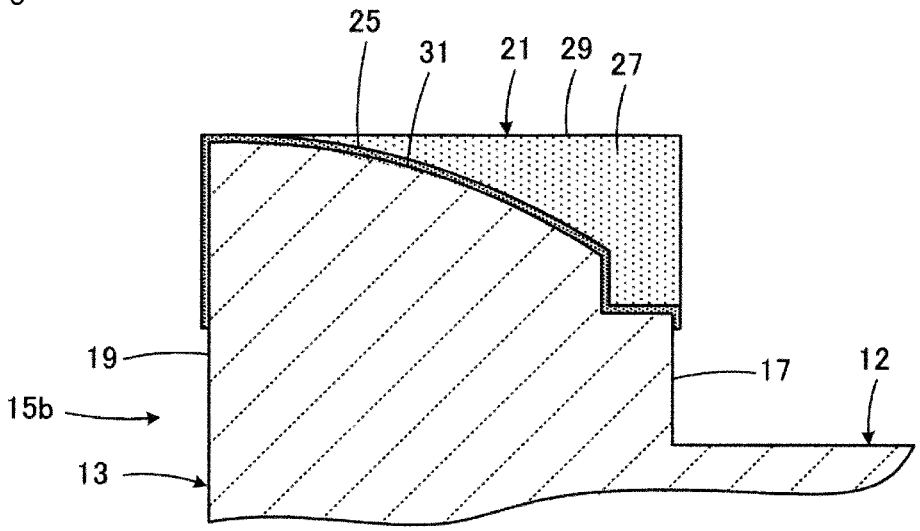
FIG. 6 is an enlarged view of a portion of a substantially drum-shaped core included in a coil component according to a third embodiment of the present disclosure and corresponds to FIG. 3.

A third embodiment of the present disclosure will now be described with reference to FIG. 6. FIG. 6 corresponds to FIG. 3 and illustrates a portion of a substantially drum-shaped core 15*b* that is included in a coil component. In FIG. 6, components that correspond to those illustrated in FIG. 3 are denoted by the same reference signs, and repeated descriptions thereof will be omitted.

In the third embodiment illustrated in FIG. 6, the rounded surface 31 does not form the entire bottom surface of the recess 27 and does not extend on the end portion of the bottom surface of the recess 27 that is located on the side on which the inner end surface 17 is present.

As in the present embodiment, advantageous effects similar to those in the above-described embodiments may be obtained not only in the case where the entire bottom surface of the recess 27 is formed of the rounded surface 31.

Figure 7:
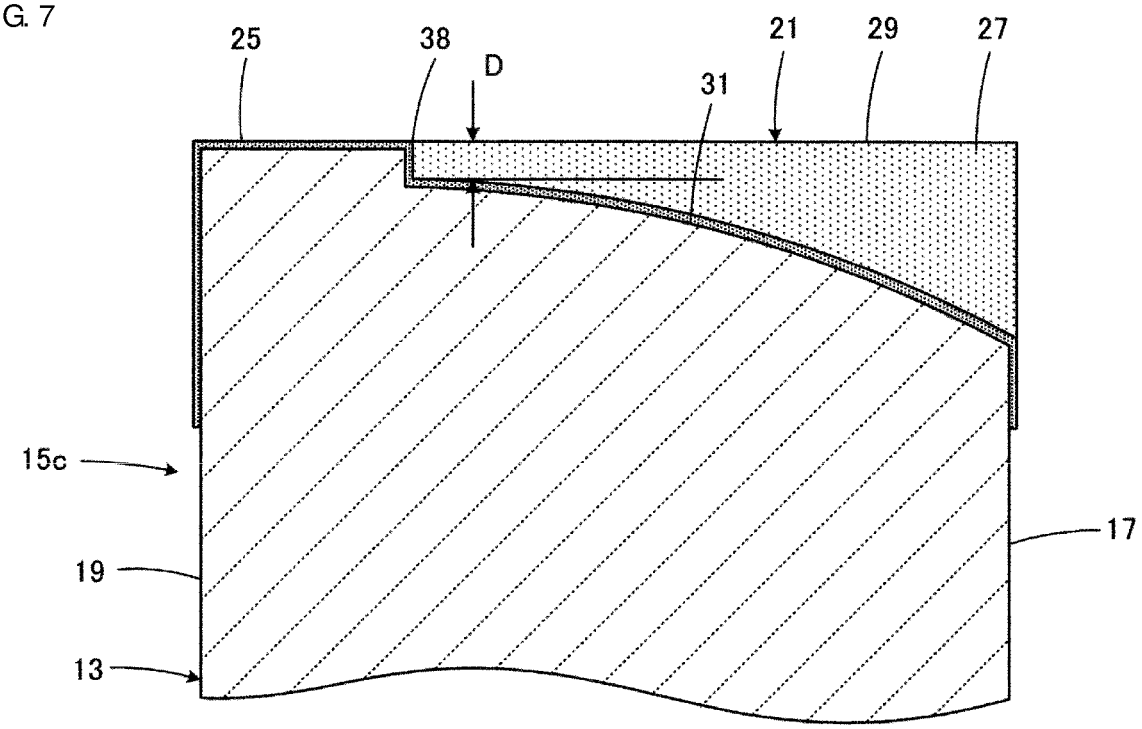
FIG. 7 is an enlarged view of a portion of a substantially drum-shaped core included in a coil component according to a fourth embodiment of the present disclosure and corresponds to FIG. 3.

A fourth embodiment of the present disclosure will now be described with reference to FIG. 7. FIG. 7 corresponds to FIG. 3 and illustrates, in a further enlarged manner than FIG. 3 does, a portion of a substantially drum-shaped core 15*c* included in a coil component. In FIG. 7, components that correspond to those illustrated in FIG. 3 are denoted by the same reference signs, and repeated descriptions thereof will be omitted.

Similar to the third embodiment illustrated in FIG. 6, in the fourth embodiment illustrated in FIG. 7, the rounded surface 31 does not form the entire bottom surface of the recess 27. In the fourth embodiment illustrated in FIG. 7, the rounded surface 31 does not extend on the end portion of the bottom surface of the recess 27 that is located on the side on which the inner end surface 19 is present, and a portion of the flat surface 29 is positioned between the recess 27 and the inner end surface 19 with a step portion D interposed between the portion of the flat surface 29 and the recess 27. In addition, an angular edge 38 is formed at an end edge formed of the step portion D, which is formed at the portion of the flat surface 29 that is located on the side on which the outer end surface 19 is present.

It is preferable that the above-mentioned step portion D be about 1/10 or more and about ⅓ or less (i.e., from about 1/10 to about ⅓) the diameter of the portion of the wire 23 that is wound around the winding core portion 12. According to the present embodiment, when the wire 23 is bonded to the terminal electrode 25 by thermocompression bonding, a stress is concentrated at the edge 38. Thus, an unnecessary end portion of the wire 23 can be cut off with a small pressing force, and regardless of the dimensions and the shape of the thermocompression-bonding head 33 (see FIG. 4) used for the thermocompression bonding and the application position of the thermocompression-bonding head 33, the thermocompression bonding can be more reliably controlled such that the amount of deformation of the wire 23 will not become excessive.

Although the second to fourth embodiments have been described with reference to FIG. 5 to FIG. 7, only the configuration on the side on which the first flange portion 13 is present is illustrated in FIG. 5 to FIG. 7, and only the configuration on the side on which the first flange portion 13 is present has been described. Although description of the configuration on the side on which the second flange portion 14 is present is omitted, the configuration on the side on which the second flange portion 14 is present is symmetrical to the configuration on the side on which the first flange portion 13 is present.

According to the above-described embodiments, the end portions of the wire 23 that are connected to the terminal electrodes 25 and 26 can each have a portion where the pressure that is applied to the wire 23 in the thermocompression bonding process continuously changes such that the pressure becomes stronger with decreasing distance from the end of the wire 23, that is, a portion where the pressure continuously changes such that the pressure becomes weaker with increasing distance from the end of the wire 23.

Thus, in a certain length range of each of the end portions of the wire 23, which are connected to the terminal electrodes 25 and 26, the state in which the pressure applied in thermocompression bonding continuously changes in the lengthwise direction of the wire 23 is obtained. Thus, in this length range, there is always a portion having press-bonding strength that is further improved than that in a structure of the related art. As a result, in the coil component 11, prevention of breakage of the wire 23 and stable thermocompression bonding can be simultaneously achieved.

Although the present disclosure has been described above in connection with the embodiments illustrated in the drawings, the present disclosure can employ other various embodiments within the scope of the present disclosure.

For example, although not illustrated, a substantially plate-shaped core may be provided so as to connect two surfaces of the substantially drum-shaped core 15 to each other, each of the two surfaces opposing to one of the mounting surface 21 of the first flange portion 13 and the mounting surface 22 of the second flange portion 14. In the case where both the substantially drum-shaped core 15 and the substantially plate-shaped core are made of a magnetic material, the substantially drum-shaped core 15 and the substantially plate-shaped core form a closed magnetic circuit.

In addition, although each of the above-described embodiments relates to a coil component that includes a single wire, for example, the present disclosure can also be applied to a coil component that includes a plurality of wires, such as a coil component that forms a common-mode choke coil or a coil component that forms a transformer. Thus, the number of wires is changed in accordance with the function of the coil component, and accordingly, the number of terminal electrodes provided at each flange portion is not limited to one and may be plural. In the case where the number of terminal electrodes provided at each flange portion is plural, a plurality of terminal electrodes are arranged in the widthwise direction of each flange portion so as to be electrically isolated from each other. Therefore, a plurality of recesses are provided so as to be arranged in the widthwise direction of each flange portion.

In addition, the rounded surfaces 31 and 32 may be respectively formed on the entire bottom surfaces of the recesses 27 and 28 or may be respectively formed on only portions of the bottom surfaces of the recesses 27 and 28. As in the latter case, when the rounded surfaces 31 and 32 are respectively formed only on portions of the bottom surfaces of the recesses 27 and 28, the rounded surfaces 31 and 32 may be formed in one of the following patterns. As a first pattern, the rounded surface 31 may be formed only in a region of the flange portion 13 that is located on the side on which the inner end surface 17 is present, and the rounded surface 32 may be formed only in a region of the flange portion 14 that is located on the side on which the inner end surface 18 is present. As a second pattern, the rounded surface 31 may be formed only in a region of the flange portion 13 that is located on the side on which the outer end surface 19 is present, and the rounded surface 32 may be formed only in a region of the flange portion 14 that is located on the side on which the outer end surface 20 is present. As a third pattern, the rounded surfaces 31 and 32 may be respectively formed only at central portions of the recesses 27 and 28. In the above three patterns, a portion of the bottom surface of the recess 27 that is not the rounded surface 31 may be a surface having a slope with respect to the mounting surface 21 or may be a surface parallel to the mounting surface 21, and a portion of the bottom surface of the recess 28 that is not the rounded surface 32 may be a surface having a slope with respect to the mounting surface 22 or may be a surface parallel to the mounting surface 22.

In addition, although it is preferable that the rounded surfaces 31 and 32 be formed in a convex manner as in the embodiments illustrated in the drawings because the press-bonding of the wire 23 may be easily performed with the rounded surfaces 31 and 32 formed in a convex manner, the rounded surfaces 31 and 32 may be formed in a recessed manner.

The scope of the present disclosure is not limited to the above-described embodiments and includes other embodiments that are obtained by partially replacing or combining the configurations according to the above-described different embodiments with one another.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a substantially drum-shaped core including a winding core portion and a flange portion that is provided at an end portion of the winding core portion;

a wire wound around the winding core portion; and a terminal electrode to which an end portion of the wire is connected, wherein the flange portion has an inner end surface that faces the winding core portion and that positions the end portion of the winding core portion, an outer end surface that is opposite to the inner end surface and that faces outward, and a mounting surface that connects the inner end surface and the outer end surface to each other and that is directed to a mounting substrate at the time of mounting the coil component, the terminal electrode is disposed on the mounting surface of the flange portion, a rounded surface and a flat surface are formed on the mounting surface, the rounded surface having a central axis that linearly extends in a widthwise direction parallel to the mounting surface and the outer end surface and having a curvature radius that is longer than a distance between the inner end surface and the outer end surface, and the rounded surface being between two flat portions of the flat surface of the mounting surface, and the end portion of the wire extends along the rounded surface from a side on which the inner end surface is present toward a side on which the outer end surface is present.

2. The coil component according to claim 1, wherein the central axis of the rounded surface is located on a plane along the outer end surface or is located outside the plane along the outer end surface.

3. The coil component according to claim 1, wherein a recess and the flat surface, which is different from the recess, are formed in and on the mounting surface, the recess being open on a side on which the inner end surface is present, and the rounded surface is formed in the recess.

4. The coil component according to claim 3, wherein a difference between heights of an end portion of the rounded surface, the end portion being located on the side on which the inner end surface is present, and the flat surface is equal to or smaller than a diameter of a portion of the wire that is wound around the winding core portion.

5. The coil component according to claim 3, wherein the recess becomes deeper from a side on which the outer end surface is present to the side on which the inner end surface is present.

6. The coil component according to claim 1, wherein the end portion of the wire has a thickness that continuously changes along the rounded surface.

7. The coil component according to claim 1, wherein the terminal electrode covers the entire mounting surface.

8. The coil component according to claim 2, wherein a recess and the flat surface, which is different from the recess, are formed in and on the mounting surface, the recess being open on a side on which the inner end surface is present, and the rounded surface is formed in the recess.

9. The coil component according to claim 2, wherein the end portion of the wire has a thickness that continuously changes along the rounded surface.

10. A coil component comprising:

a substantially drum-shaped core including a winding core portion and a flange portion that is provided at an end portion of the winding core portion;

a wire wound around the winding core portion; and a terminal electrode to which an end portion of the wire is connected, wherein the flange portion has an inner end surface that faces the winding core portion and that positions the end portion of the winding core portion, an outer end surface that is opposite to the inner end surface and that faces outward, and a mounting surface that connects the inner end surface and the outer end surface to each other and that is directed to a mounting substrate at the time of mounting the coil component, the terminal electrode is disposed on the mounting surface of the flange portion, a recess and a flat surface, which is different from the recess, are formed in and on the mounting surface, the recess being open on a side on which the inner end surface is present, and the recess being between two flat portions of the flat surface of the mounting surface, and the end portion of the wire is received in the recess from the side on which the inner end surface is present toward a side on which the outer end surface is present and has a thickness that continuously changes such that the thickness is relatively thin on the side on which the outer end surface is present and is relatively thick on the side on which the inner end surface is present.

11. The coil component according to claim 10, wherein a difference between heights of a bottom surface of the recess and the flat surface is equal to or smaller than a diameter of a portion of the wire that is wound around the winding core portion.

12. The coil component according to claim 10, wherein the recess becomes deeper from the side on which the outer end surface is present to the side on which the inner end surface is present.

13. The coil component according to claim 10, wherein a rounded surface is formed on at least a portion of the bottom surface of the recess, the rounded surface having a central axis that linearly extends in a widthwise direction parallel to the mounting surface and the outer end surface and having a curvature radius that is longer than a distance between the inner end surface and the outer end surface.

14. The coil component according to claim 10, wherein on the mounting surface, a portion of the flat surface is positioned between the recess and the inner end surface with a step portion interposed between the portion of the flat surface and the recess, and an angular edge is formed at an end edge formed of the step portion, which is formed at the portion of the flat surface that is located on the side on which the outer end surface is present.

15. The coil component according to claim 14, wherein the step portion is from about 1/10 to about 1/3 the diameter of the portion of the wire that is wound around the winding core portion.

16. The coil component according to claim 10, wherein the flat surface is positioned such that the recess is sandwiched by portions of the flat surface.

17. The coil component according to claim 10, wherein the terminal electrode covers the entire mounting surface.

18. The coil component according to claim 11, wherein a rounded surface is formed on at least a portion of the bottom surface of the recess, the rounded surface having a central axis that linearly extends in a widthwise direction parallel to the mounting surface and the outer end surface and having a curvature radius that is longer than a distance between the inner end surface and the outer end surface.

19. A coil component comprising:

a substantially drum-shaped core including a winding core portion and a flange portion that is provided at an end portion of the winding core portion;

a wire wound around the winding core portion; and a terminal electrode to which an end portion of the wire is connected, wherein the flange portion has an inner end surface that faces the winding core portion and that positions the end portion of the winding core portion, an outer end surface that is opposite to the inner end surface and that faces outward, and a mounting surface that connects the inner end surface and the outer end surface to each other and that is directed to a mounting substrate at the time of mounting the coil component, the terminal electrode is disposed on the mounting surface of the flange portion, a recess and a flat surface, which is different from the recess, are formed in and on the mounting surface, the recess being open on a side on which the inner end surface is present, the end portion of the wire is received in the recess from the side on which the inner end surface is present toward a side on which the outer end surface is present and has a thickness that continuously changes such that the thickness is relatively thin on the side on which the outer end surface is present and is relatively thick on the side on which the inner end surface is present, on the mounting surface, a portion of the flat surface is positioned between the recess and the inner end surface with a step portion interposed between the portion of the flat surface and the recess, and an angular edge is formed at an end edge formed of the step portion, which is formed at the portion of the flat surface that is located on the side on which the outer end surface is present.

20. The coil component according to claim 19, wherein the step portion is from about 1/10 to about 1/3 the diameter of the portion of the wire that is wound around the winding core portion.

* * * * *